US006582153B1

(12) United States Patent
Allen et al.

(10) Patent No.: US 6,582,153 B1
(45) Date of Patent: Jun. 24, 2003

(54) EDGE GUARDED POWER RIDING TROWEL

(75) Inventors: J. Dewayne Allen, Paragould, AR (US); Timmy D. Guinn, Paragould, AR (US)

(73) Assignee: Allen Engineering Corp., Paragould, AR (US)

( * ) Notice: Subject to any disclaimer, the term of this patent is extended or adjusted under 35 U.S.C. 154(b) by 0 days.

(21) Appl. No.: 10/042,329

(22) Filed: Jan. 11, 2002

(51) Int. Cl.[7] ..... E01C 19/22
(52) U.S. Cl. ..... 404/112
(58) Field of Search ..... 404/112, 102

(56) References Cited

U.S. PATENT DOCUMENTS 4,046,483 A * 9/1977 Sutherland ..... 404/112
D400,544 S 11/1998 Allen
D404,041 S 1/1999 Allen
5,890,833 A 4/1999 Allen
D413,127 S 8/1999 Allen
D416,564 S 11/1999 Allen
5,988,938 A 11/1999 Allen
6,019,545 A * 2/2000 Allen et al. ..... 404/112
6,053,660 A * 4/2000 Allen et al. ..... 404/112
6,106,193 A 8/2000 Allen
D466,909 S * 12/2002 Allen et al. ..... D15/10

* cited by examiner

*Primary Examiner*—Thomas B. Will
*Assistant Examiner*—Raymond W Addie
(74) *Attorney, Agent, or Firm*—Stephen D. Carver

(57) ABSTRACT

A high performance, riding trowel for finishing concrete comprises damage-preventing edge guard systems that accommodate destructive forces occasioned by collisions or impacts. Downwardly projecting, motor-driven rotor assemblies gimbaled to the frame contact the concrete with multiple blades for finishing. The rotors are tilted with linkages ideally controlled by a powered system that enhances operator control. A two-piece guard system is concentrically disposed over and rotatably associated with each rotor. The guard system comprises a captivating guard frame borne by the rotor and tilted during steering, which captivates and supports a rotatable ring guard portion that may non-destructively impact obstacles. The guard system frame suspends a plurality of rollers comprising upper and lower flanges. The rotatable guard ring is captivated upon the rollers, being vertically constrained between the flanges. When the guard ring impacts an obstruction it may freely rotate, minimizing structural damage and surface marring or disfigurement.

3 Claims, 7 Drawing Sheets

EDGE GUARDED POWER RIDING TROWEL

BACKGROUND OF THE INVENTION

1. Field of the Invention

This invention relates generally to powered, motorized riding trowels for finishing concrete surfaces. More particularly, our invention relates to protective edge guards for motorized riding trowels classified in United States Patent Class 404, Subclass 112.

2. Description of the Prior Art

Large, self-propelled riding trowels have become widely accepted in the concrete finishing arts, where they are particularly effective for rapidly and efficiently finishing large areas of plastic concrete. Modern, high-power, multiple engine riding trowels with power steering are highly desirable. They can finish large surface areas of wet concrete much more efficiently than single engine riding trowels or the older "walk behind" trowels. Significant savings are experienced by the contractor using such equipment with large jobs, as time constraints and labor expenses are reduced.

Typical riding trowels have two or three downwardly projecting rotors that contact the concrete surface and support the trowel weight. Each rotor comprises radially, spaced apart finishing blades that frictionally revolve upon concrete surface. The rotor blades can receive circular finishing pans for treating green concrete. When the rotors are tilted, steering and propulsion forces are frictionally developed by the blades (or pans) against the concrete surface. Riding trowels finish large surface areas of wet concrete more efficiently than older "walk behind" trowels. Significant savings are experienced by the contractor using such equipment, as time constraints and labor expenses are reduced.

Holz, in U.S. Pat. No. 4,046,484 shows a pioneer, twin rotor, self-propelled riding trowel wherein the rotors are tilted to generate steering forces. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation.

U.S. Pat. No. 5,613,801, issued Mar. 25, 1997 to Allen Engineering Corporation discloses a power-riding trowel equipped with separate motors for each rotor. Steering is accomplished with structure similar to that depicted in U.S. Pat. No. 5,108,220 previously discussed.

Allen Engineering Corporation U.S. Pat. No. 5,480,258 discloses a multiple engine riding trowel. The twin rotor design depicted therein associates a separate engine with each rotor. As the engines are disposed directly over each revolving rotor assembly, horsepower is more efficiently transferred to the revolving blades. Besides resulting in a faster and more efficient trowel, the design is easier to steer. Again, manually activated steering linkages are used. Allen Engineering Corporation U.S. Pat. No. 5,685,667 discloses a twin engine riding trowel using "contra rotation."

Modern riding trowels, such as the Allen trowels with multiple motors listed above, are characterized by relatively high power. Simply stated, large, powerful riding trowels finish large work areas faster. Although earlier riding trowels used manually-operated levers for steering, modem high-power trowels are easier to control with power steering. For example, Allen Engineering Corporation, the owner of this invention, has developed high power, hydraulically controlled trowels illustrated in U.S. Pat. Nos. 6,106,193, 6,089,787, 6,089,786, 6,053,660, 6,048,130, and 5,890,833. It is now well recognized that power steering systems engender the maximum overall performance. Quick and responsive handling characteristics optimize trowel efficiency, while contributing to operator safety and comfort. All of these factors translate to vital speed at the job site.

As a practical matter it can be difficult to properly finish concrete regions immediately adjacent walls or other obstacles with motorized finishing trowels. There is an annular gap between the outermost radial edges of the rotor blades and the periphery of the conventional blade guard that concentrically shrouds them. Even if, for example, a conventional riding trowel is driven into gentle contact with a surrounding wall at the extreme edges of a job site, there will still be an inaccessible boundary region that is out of reach of the rotor blades that remains unfinished. Further, trowel contact with the surrounding wall or other obstacles within the work space can result in damage, both to the trowel and/or the items or structures forcibly bumped by the trowel. As trowel speed is increased, the frequency of unwanted collisions inevitably increases. Conventional trowel guards that shroud the rotor can scrape against and possibly mar or damage the wall or other structures impacted. Accordingly Allen has developed a rotating ring system for minimizing impact damage in walk-behind trowels, as illustrated in U.S. Pat. No. 6,019,545.

U.S. Pat. Nos. 5,221,156 and 5,533,830 disclose concrete finishing machines comprising a rotatable, disk-shaped guard that is spaced above the revolving finishing blades. The coaxially aligned guard disk contacts adjacent walls and obstacles, and provides a limited guard function. In these machines the guard disk centers are coaxially coupled to downwardly-projecting drive shaft structure at the center of motor rotation. For clearance purposes, rotor guards secured according to the teachings of the latter patents must be relatively flat and disk-like, and they are not adequate for riding trowel use.

SUMMARY OF THE INVENTION

The preferred trowel comprises a two or more spaced apart rotors gimbaled to the frame. Each downwardly projecting rotor revolves multiple, radially spaced apart blades that frictionally contact the concrete. One or more internal combustion motors power the rotors, either through mechanical gear boxes or hydraulic means. If hydraulic actuators are used, suitable hydraulic pumps for energizing the hydraulic accessories are mounted upon the trowel frame and driven by the motors. Where power steering is employed, suitable joysticks are conveniently placed near the operator.

The preferred edge guard system comprises a supporting frame portion that structurally mounts upon each rotor, circumscribing the center of rotation. Tilting movements of the rotor responsible for steering thus deflect the guard system as well. The guard frame suspends a plurality of rollers at radially spaced apart intervals. The guard ring comprises an inner, upper lop coaxially connected to a larger, lower, outer loop that is exposed to obstacle contact. Radially spaced apart spokes extending between the inner and outer loops reinforce the rotating ring. Each roller comprises spaced-apart upper and lower flanges disposed on opposite sides of a roller surface, between which the inner loop of the guard ring is captivated.

When the trowel inadvertently contacts an obstacle, the lower guard ring makes first contact. Rather than marring or scratching an impacted surface, the guard ring is rotatably deflected, enabling the power trowel to smoothly traverse boundary regions of concrete surfaces. Impact forces from inadvertent collisions are dissipated as the guard ring rotates and the trowel is non-destructively deflected.

Thus a basic object of our invention is to provide a power rising trowel especially adapted to minimize collision damages.

Another fundamental and basic object is to provide a riding trowel with a guard system that minimizes the marring or defacement of impacted items.

Another object is to provide a trowel of the character described that reaches and finishes border regions near walls and obstacles.

Another fundamental object is to provide a guard system of the character described that does not interfere with the normal steering function and tilting characteristics of power riding trowel rotors.

A similar object is to provide a high power riding trowel that may be driven closely up against walls and other obstacles during concrete finishing.

Another object of our invention is to provide a high power riding trowel of the character described that remains safe and stable despite impact with nearby walls and obstacles.

Yet another object is to provide a highly stable riding trowel guard system that concentrically moves with the rotor.

Another important object is to provide an impact-responsive guard system for power riding trowels that protectively shrouds the blades.

A related design object is to provide an impact-accommodating guard system that may be employed upon a variety of modem high powered riding trowels, including hydraulically-steered trowels, hydraulically driven trowels, and trowels with two, three or more rotors.

Still another object is to provide a riding trowel guard system that accommodates reasonable impact forces in response to collisions.

Another object is to provide an impact-accommodating guard system of the character described for riding trowels driven by diesel or gasoline powered motors.

It is also an object to provide a guard system of the character described that may be retrofitted to hydraulically steered and hydraulically driven designs.

A related object is to provide a guard system for multiple rotor riding trowels that tends to isolate each rotor from shocks experienced from collisions.

Another basic object is to provide a guard system for riding trowels that works with either standard rotation or contra rotation.

A further object is to provide a trowel guard system that is readily compatible with conventional blades, combo-blades, or finishing pans.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 1:
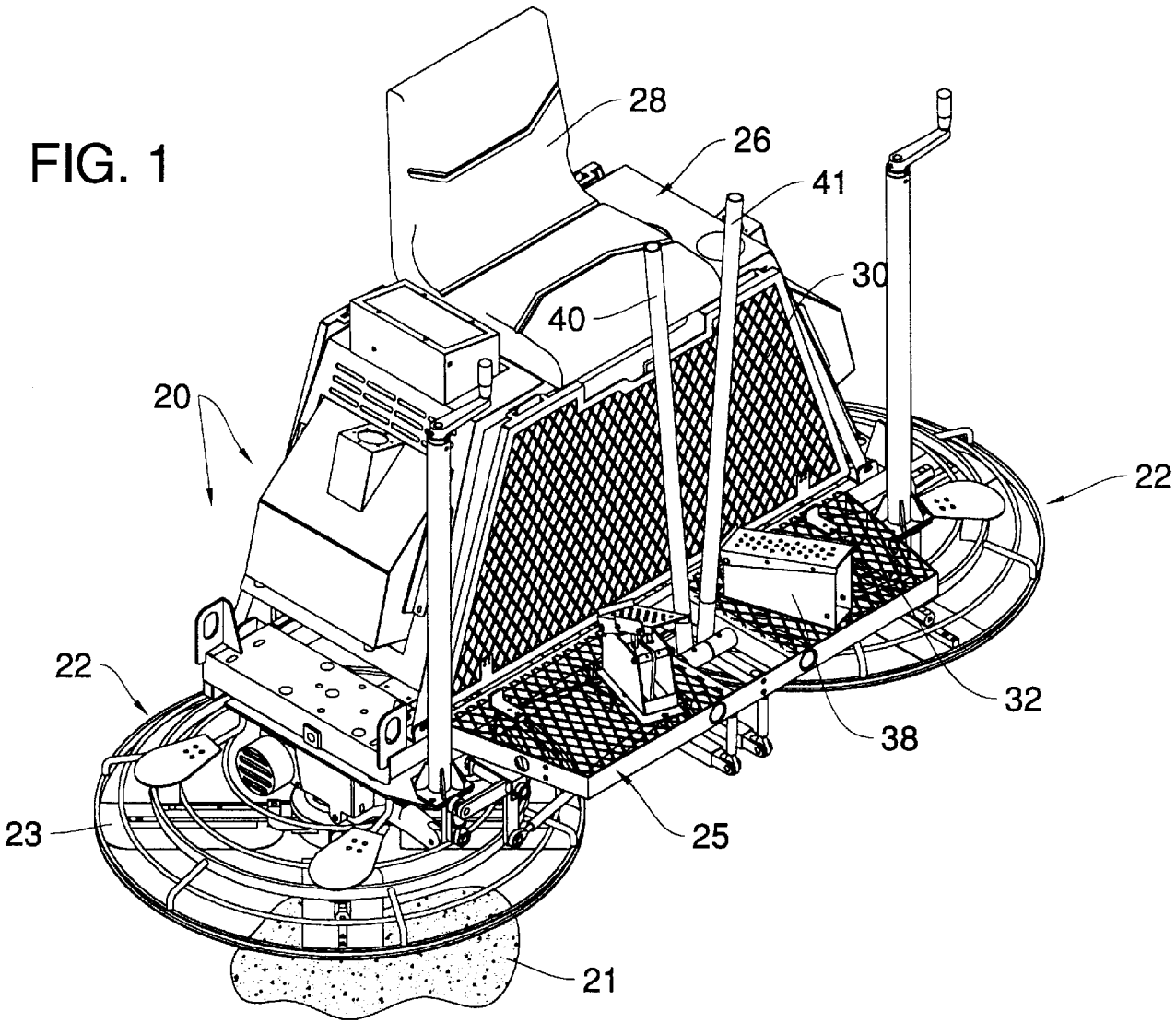
FIG. 1 is a frontal isometric view of our new riding trowel showing the new edge guards associated with each rotor.
Figure 2:
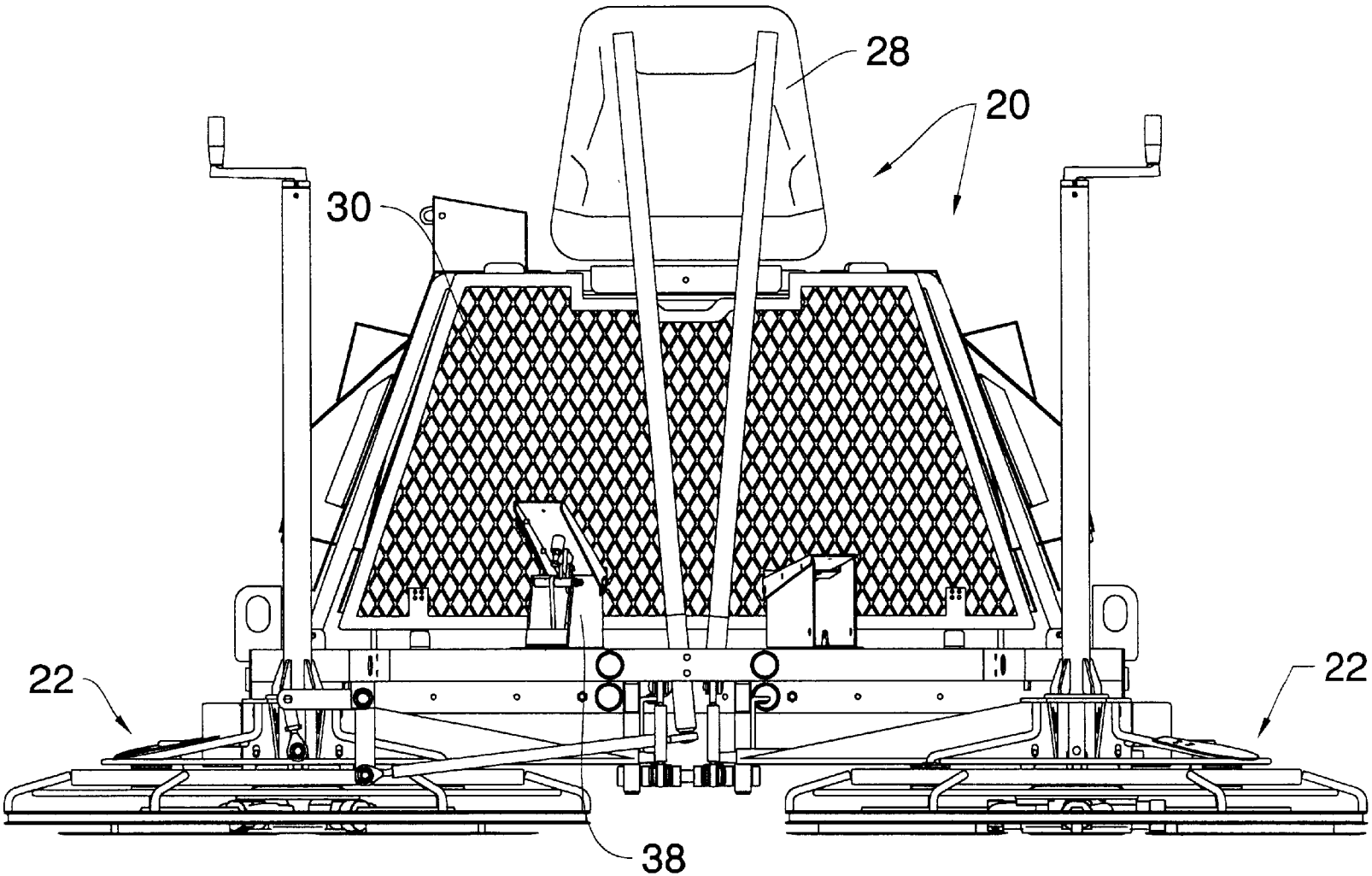
FIG. 2 is a front plan view thereof, with portions thereof broken away or shown section for clarity, or omitted for brevity.
Figure 3:
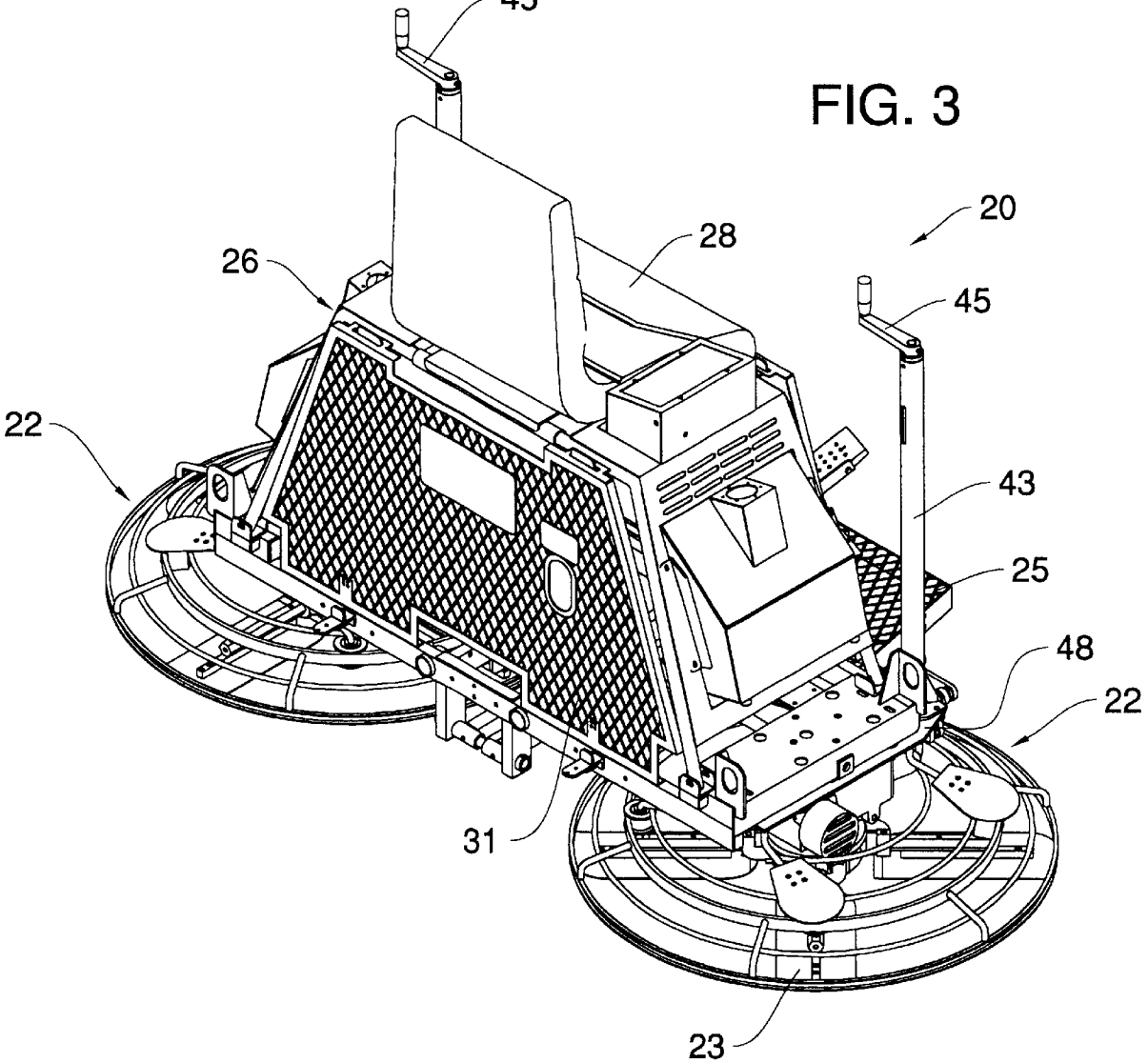
FIG. 3 is a rear isometric view of thereof, with portions thereof broken away or shown section for clarity, or omitted for brevity.
Figure 4:
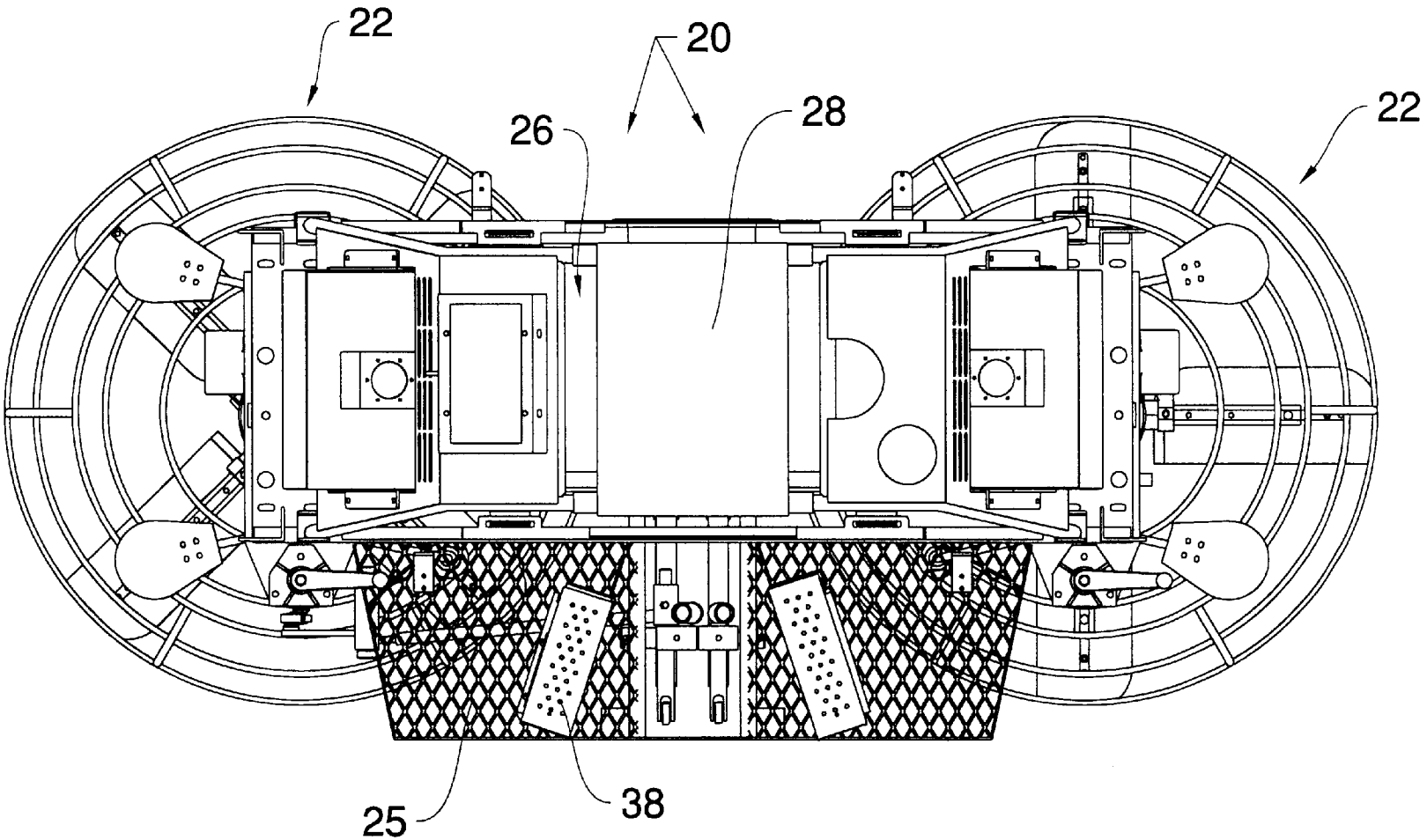
FIG. 4 is a top plan view thereof, with portions thereof broken away or shown section for clarity, or omitted for brevity.

With initial reference directed now to FIGS. 1–4 of the appended drawings, a power riding trowel broadly designated by the reference numeral 20 comprises a pair of downwardly projecting rotors 22 equipped with our new guard system to be hereinafter described. Each rotor has a number of blades 23 that directly frictionally contact the concrete surface 21. Structural details of pertinent riding trowels illustrating basic structural concepts trowel 20 are set forth in detail in prior U.S. Pat. Nos. 5,108,220, 5,613,801, 5,480,257, 5,685,667, 5,890,833, 6,019,545, 6,048,130, 6,053,660, 6,089,786, 6,089,787, and 6,106,193, which, for disclosure purposes, are hereby incorporated by reference herein. The new ring guard system minimizes impact damages that might otherwise be experienced by the trowel in response to collisions.

Riding trowel 20 comprises a rigid, supporting metal frame 25 supporting an upright midsection 26 that mounts a seat 28 for the driver (not shown). Motor means (not seen) shrouded between guard cage panels 30, 31 (FIG. 3) forming opposite sides of midsection 26. The spaced apart rotors 22 are gimbaled to the frame 25 and project downwardly into contact with concrete surface 21, and the radially spaced apart blades 23 support the trowel 20 and the operator over the surface 21. As explained in detail in the previously cited patents, operator control is facilitated by a pair of foot pedals 38 on frame 25. Steering is effectuated by control levers 40, 41 at the machine front which ultimately tilt the rotors for steering. Upwardly projecting stanchions 43 have conventional handles 45 for controlling rotor blade pitch.

Figure 5:
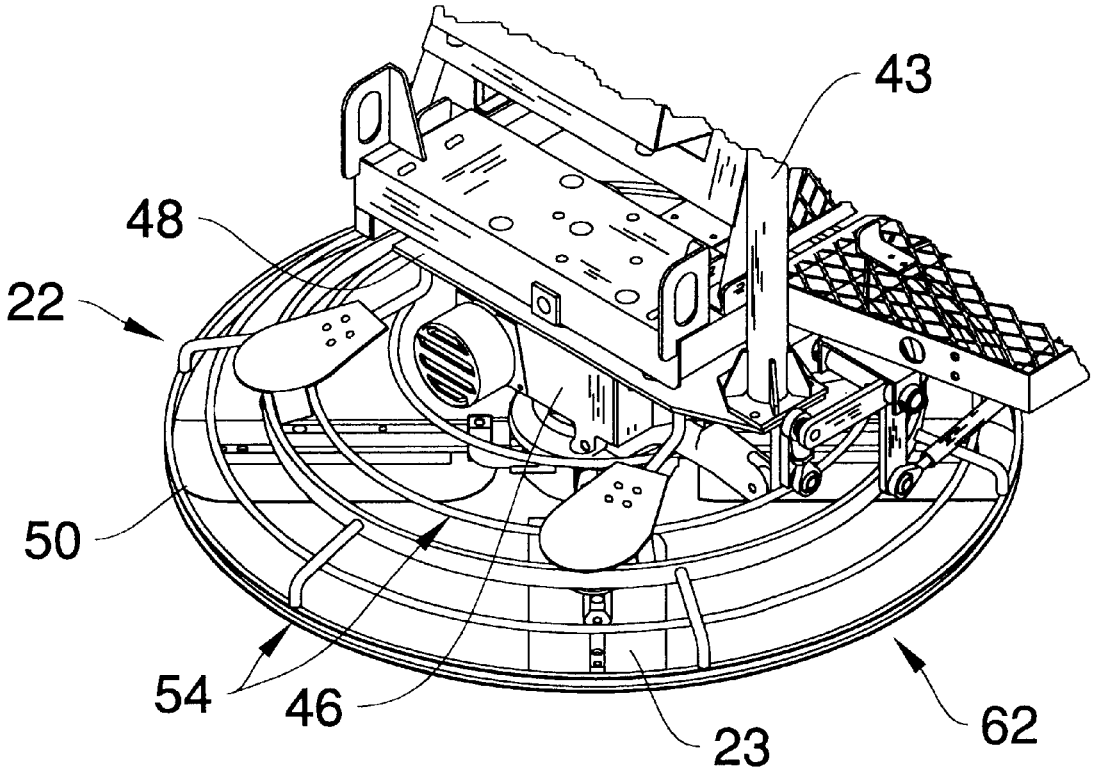
FIG. 5 is an enlarged, fragmentary isometric view of the rotor on the right side of a seated operator.
Figure 6:
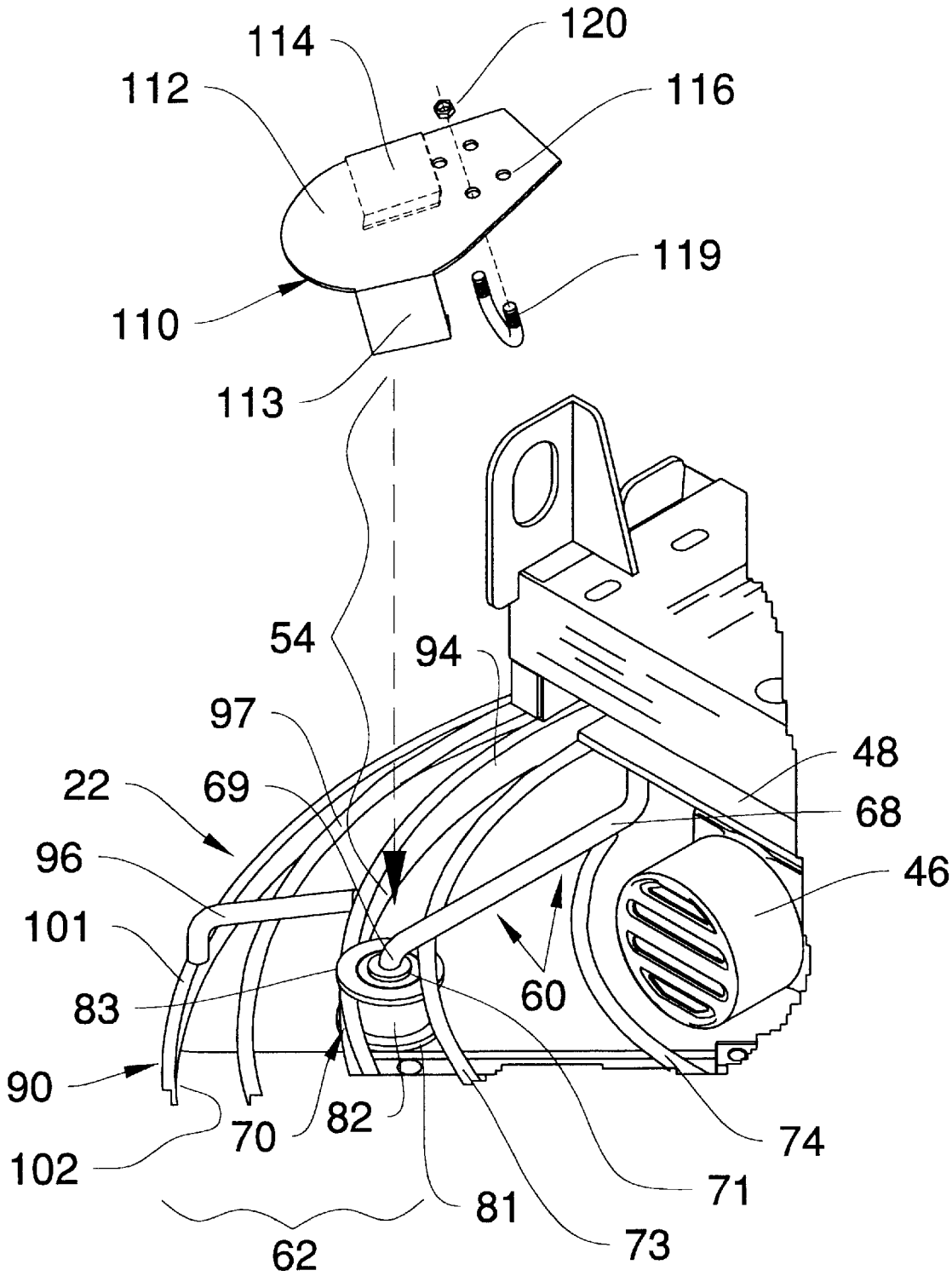
FIG. 6 is an enlarged, fragmentary isometric view of region 6 seen in FIG. 5; and, FIG. 7 is an enlarged, fragmentary top isometric view of the rotor to the left of a seated operator, showing the preferred guard system, with portions thereof broken away or shown section for clarity, or omitted for brevity.
Figure 7:
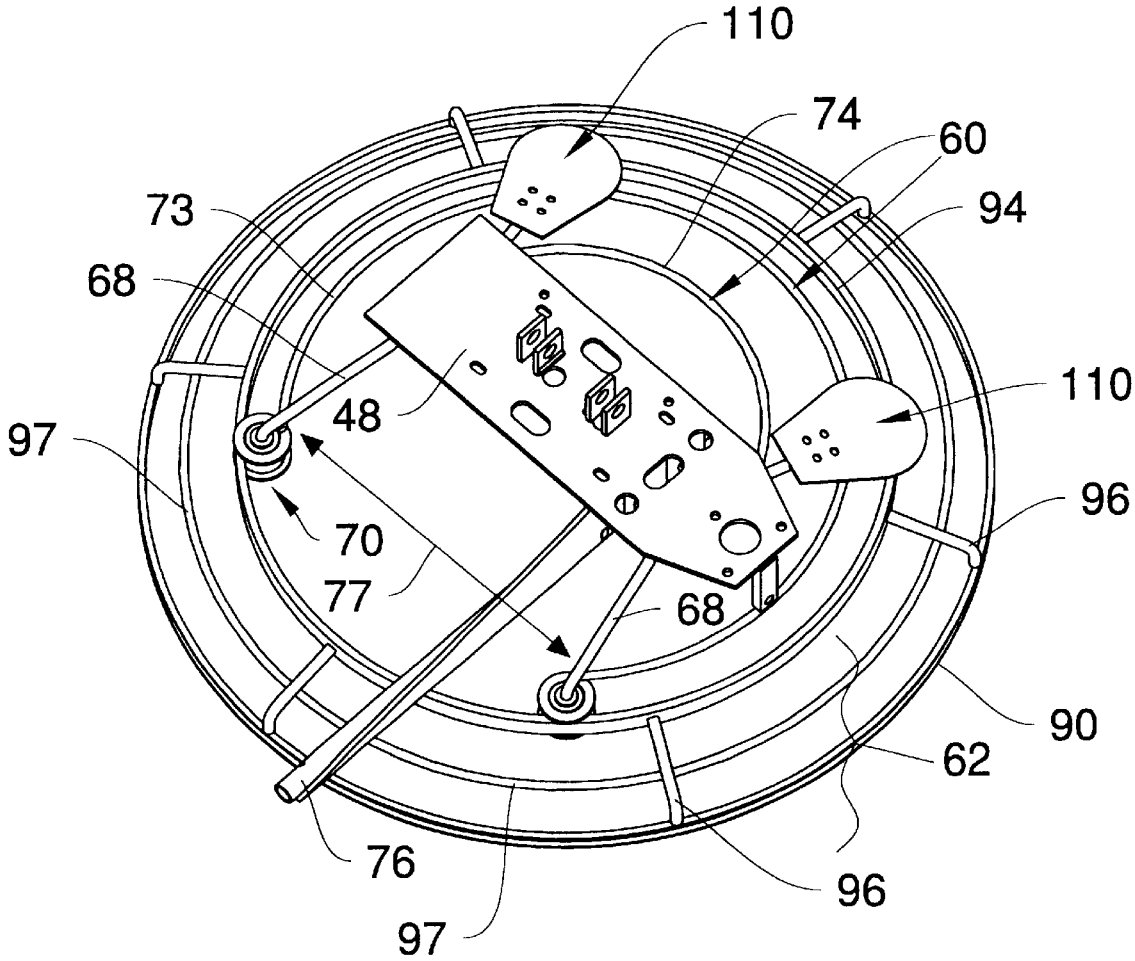

With additional reference now directed to FIGS. 5 and 6, each rotor 22 is driven by either a gearbox 46 or hydraulic drive motor; in either case the gearbox or hydraulic motor is mounted on a gimbal plate 48, that is part of the rotor tilting or gimble mounting structure explained in detail in the previously cited patents. The outermost tip portions 50 (FIG. 5) of the finishing blades circumscribe a circle whose diameter is slightly exceeded by the effective diameter of the guard assembly, generally designated by the reference numeral 54 (FIGS. 5–7). Guard system 54 is concentrically disposed about the center of rotation of the rotor; therefore it is concentric therewith. At the same time, guard system 54 is mechanically supported by the rotor gimbal plate 48, rather than being directly coupled to the frame, so it moves with the rotor when the rotor is tilted during steering movements.

The guard system 54 preferably comprises a supportive frame system 60 (FIGS. 6,7) which is secured to and supported by and beneath plate 48. Alternatively it could be connected to other major rotor structure, as long as it is not directly connected to the trowel frame. Guard frame 60 comprises a plurality (preferably four) radially spaced apart arms 68 emanating from beneath plate 48 that terminate in downwardly turned end portions 69 coupled to suitable rollers 70. Each roller 70 has a suitable internal bearing, generally designated by the reference numeral 71 (FIG. 6) in which arm ends 69 are press-fitted or seated. Guard frame portion 60 includes a partially circular reinforcement strut 73 that extends between and is welded to the various arms 68. The "open end" or clearance region 77 (FIG. 7) permits unobstructed passage of the rotor tilting link or "torque rod" 76 that is secured to plate 48 for rotor tilting or steering. On the opposite side of the plate 48 there is a semicircular reinforcement strut 74 extending between arms 68 on that side that is concentric with reinforcement strut 73.

The rotatable ring guard 62 (FIGS. 6–7) is captivated upon rollers 70, between the spaced apart flanges 81 and 83 (FIG. 6). When guard system 54 is moved against an obstacle the ring guard 62 can rotate, and it will not scratch or deface contacted obstacles. The preferred ring guard 62 comprises an outermost, lower ring 90 that is elevated a slight clearance distance above the concrete surface 21. A rigid, concentric inner track ring 94 spaced above outermost ring 90 has a reduced diameter. A plurality of radially spaced apart spokes 96 extending between rings 90 and 94 reinforce the guard assembly. An optional, concentric reinforcement ring 97 is welded to spokes 96 concentrically between rings 90 and 94. As best seen in FIG. 6, ring 90 preferably has a channel cross section, comprising flange portions 101 and a vertically oriented band 102. A resilient extrusion (not shown) may be glued into place upon band 102 to prevent ring 90 from scratching or damaging contacted surfaces. Preferably ring 94 is rolled from a length of flat steel, and its generally rectangular cross section mates to the roller surfaces 82 between the roller flanges 81, 83. Vertical and horizontal guard movements relative to the rotor 22 are thus resisted by the roller and its flanges. The cross section of optional, concentric reinforcing ring 97 is round.

As best seen in FIG. 6, each roller 70 is preferably shrouded by a cover plate 110 that prevents ones hands from being squeezed into abutment with the rollers 70. Although not a proper lift point, some operators lift the trowel by grasping the rotatable guard 62, which can shift position as the guard is free to rotate. The cover plates 110 guard against the hand being pinched within the rollers. Preferably each cover plate 110 comprises a planar body portion 112 integral with a pair of downwardly projecting sides guards 113, 114. Orifices 116 in plate body portion 112 enable U-bolts 119 to clasp and surmount arms 68 for mounting. When tightened, that nuts 120 firmly install the cover plates.

When the guard system 54 contacts an obstacle, the lower, outer ring 90 makes contact, and the guard assembly rotates. Rotation is confined between and about the about the rollers 70 discussed earlier. Forces that might otherwise damage the riding trowel or obstacles contacted by it are dissipated and displaced.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A power riding trowel comprising:

downwardly projecting rotor means for finishing concrete surfaces, the rotor means comprising blade means for frictionally contacting said surface(s);

means for rotating said rotor means;

means for gimbal mounting said rotor means;

guard means for shrouding said rotor means, said guard means comprising:

a guard frame coaxially aligned with respect to said rotor means, said guard frame comprising a plurality of radially spaced apart arms terminating in rollers; and, a rotatable ring guard substantially coaxial with said rotor means and disposed vertically above said surface to be finished, the ring guard comprising an outermost ring comprising a diameter sufficient for it to circumscribe the outermost portions of said blade means and an inner concentric ring entrained upon said rollers;

a link extending to said gimbal mounting means for tilting the rotor means;

a clearance region for clearing said link defined by said guard frame;

cover means mounted on said guard frame arms for shrouding said rollers;

wherein said rollers register with and captivate said inner concentric ring to support said ring guard; and, said guard frame comprises partially circular reinforcement struts extending between at least a plurality of said arms, on a side of said rotor means opposite said clearance region.

2. A power riding trowel for finishing concrete surfaces, said trowel comprising:

a pair of spaced apart, downwardly projecting rotors, each rotor comprising a plurality of blades for frictionally contacting the concrete surface(s);

motors for rotating said rotors;

a gimbal mounting system for controlling each rotor;

a guard for shrouding each rotor, each guard comprising:

a guard frame secured to said gimbal mounting system and coaxially aligned with respect to said rotor, said guard frame comprising a plurality of radially spaced apart arms terminating in rollers; and, a rotatable ring guard substantially coaxial with said rotor and disposed vertically above said surface to be finished, the ring guard comprising an outermost ring comprising a diameter sufficient for it to circumscribe the outermost portions of said rotor blades and an inner, concentric ring entrained upon said rollers;

a link extending to said gimbal mounting system for tilting the rotors;

a clearance region for clearing said link defined by said guard frame;

a cover mounted on at least one of said guard frame arms for shrouding said rollers;

wherein said rollers register with and captivate said inner concentric ring to support said ring guard; and, said guard frame comprises partially circular reinforcement struts extending between at least a plurality of said arms, on a side of said rotor opposite said clearance region.

3. A riding trowel for finishing concrete, said trowel comprising:

downwardly projecting rotor means for finishing said concrete, the rotor means comprising blade means for frictionally contacting said concrete;

means for powering said rotor means;

guard means for shrouding said rotor means, said guard means comprising:

a guard frame secured to said rotor means; and coaxially aligned with respect to said rotor means, said guard frame comprising a plural of radially spaced apart arms terminating in rollers; and, a ring guard rotatably supported by said guard frame coaxially with respect to said rotor means, the ring guard comprising an outer ring substantially coaxial with said rotor means and disposed above said concrete to be finished, the outer ring comprising a diameter sufficient for it to circumscribe the outermost portions of said blade means and an inner concentric ring that is coaxial with and elevated above said outer ring, the inner ring comprising a diameter less than the diameter of said outer ring; and entrained and captivated by and upon said rollers;

a link for tilting the rotor;

a clearance region for said clearing link defined by said guard frame;

cover means mounted on said guard frame arms for shrouding said rollers; and, wherein said rollers comprise a pair of spaced apart flanges that prevent vertical guard movements and a rolling surface between said flanges that supports and contacts said ring guard inner ring.

* * * * *